US006886514B2

(12) United States Patent
Matsuda

(10) Patent No.: US 6,886,514 B2
(45) Date of Patent: May 3, 2005

(54) PERSONAL WATERCRAFT AND ENGINE MOUNTED IN PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/376,132

(22) Filed: Feb. 28, 2003

(65) Prior Publication Data

US 2003/0213453 A1 Nov. 20, 2003

(30) Foreign Application Priority Data

Mar. 4, 2002 (JP) ..... 2002-056938

(51) Int. Cl.[7] ..... H01T 13/06; F02P 11/00

(52) U.S. Cl. ..... 123/169 PA; 123/143 C; 439/125

(58) Field of Search ..... 123/143 C, 169 PA, 123/169 PH, 635; 439/125, 127, 128

(56) References Cited

U.S. PATENT DOCUMENTS 5,146,906 A * 9/1992 Agatsuma ..... 123/635
5,324,207 A * 6/1994 Itoh et al. ..... 439/125
5,878,706 A * 3/1999 Akamatsu ..... 123/143 C
6,591,819 B2 * 7/2003 Tscherne et al. ..... 123/572

FOREIGN PATENT DOCUMENTS

| | | |
|---|---|---|
| JP | U03-92567 | 9/1991 |
| JP | 09/189234 | 7/1997 |
| JP | 11-022604 | 1/1999 |
| JP | 2000-110660 | 4/2000 |
| JP | 2001-244133 | 9/2001 |

* cited by examiner

*Primary Examiner*—Tony M. Argenbright
(74) *Attorney, Agent, or Firm*—Kolisch Hartwell, P.C.

(57) ABSTRACT

Disclosed is an engine of a personal watercraft capable of preventing water ingress into a penetrating hole for attaching an ignition plug. The engine comprises a cylinder head, a cylinder head cover provided over the cylinder head, an ignition plug attached to the cylinder head, a penetrating hole formed to extend from an upper surface of the cylinder head cover to a lower surface of the cylinder head, for accommodating and attaching the ignition plug inside thereof, a connecting member connected to an upper end of the ignition plug and located inside the penetrating hole, for connecting a power supply to the ignition plug that activates the ignition plug, a closing member for creating a seal between the connecting member and the penetrating hole, and an air hole formed to extend obliquely downward from the penetrating hole so as to communicate with an outside of the cylinder head.

10 Claims, 6 Drawing Sheets

PERSONAL WATERCRAFT AND ENGINE MOUNTED IN PERSONAL WATERCRAFT

BACKGROUND OF THE INVENTION

1. Field of the Invention

The present invention relates to a personal watercraft (PWC) and an engine mounted in the personal watercraft. More particularly, the present invention relates to a jet-propulsion personal watercraft which ejects water pressurized and accelerated by a water jet pump rearward and planes on a water surface as the resulting reaction, and an engine mounted in a body of the watercraft.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In the personal watercraft, an engine for driving the water jet pump is contained in an engine room inside a body constituted by a deck and a hull. The body is provided with an opening such as an air inlet for feeding fresh air to the engine inside the engine room. Therefore, during cruising of the watercraft, water outside the watercraft enters the engine room through the opening.

Recently, the use of a four-cycle engine in the personal watercraft has been contemplated. In some four-cycle engines, an ignition plug is attached to a top portion of a cylinder of the engine so as to extend toward a center of the cylinder. For the purpose of attaching the ignition plug, the top portion of the engine, i.e., a cylinder head and a cylinder head cover, is provided with a concave portion that opens upwardly to accommodate the ignition plug. In the engine having such a structure, the water entering the engine room might flow into the concave portion. While the concave portion provided in the top portion of the engine is located at a high position, water splashed by a rotating member inside the engine room, such as a rotating coupling or propeller shaft, might fly into the concave portion.

SUMMARY OF THE INVENTION

The present invention addresses the above described condition, and an object of the present invention is to provide a personal watercraft having an engine capable of effectively preventing water ingress into a concave portion for attaching an ignition plug of the engine, and also to provide the engine.

According to the present invention, there is provided an engine of a personal watercraft, comprising a cylinder head; a cylinder head cover provided over the cylinder head; an ignition plug attached to the cylinder head; a penetrating hole formed to extend from an upper surface of the cylinder head cover to a lower surface of the cylinder head through the cylinder head cover and the cylinder head, for accommodating and attaching the ignition plug inside thereof, the penetrating hole including a step portion axially supporting the ignition plug, and a screw portion extending downwardly from the step portion to open in the lower surface of the cylinder head, for fixing the ignition plug; a connecting member connected to an upper end of the ignition plug and located inside the penetrating hole, for connecting a power supply that activates the ignition plug to the ignition plug; a closing member for creating a seal between the connecting member and the penetrating hole; and an air hole formed to extend obliquely downward from a vicinity of the step portion so as to communicate with an outside of the cylinder head.

In this structure, the penetrating hole extends through the cylinder head cover and the cylinder head to allow the ignition plug to be attached from above the engine, and the connecting member and the closing member are provided to the penetrating hole. The engine having such a structure is capable of preventing water ingress into the periphery of the ignition plug and is therefore suitable for the personal watercraft.

Preferably, the connecting member may be comprised of a stick-shaped member protruding from an upper end of the penetrating hole. In this structure, the inside of the penetrating hole is easily sealed and removal of the connecting member and the ignition plug are easily accomplished.

Preferably, the connecting member may contain an internal ignition coil. In this structure, an ignition device is efficiently placed in an upper portion of the engine.

Preferably, the penetrating hole may be provided with an engagement protrusion on a periphery of an opening at an upper end of the penetrating hole, and the closing member may be comprised of an upper inner peripheral portion in contact with a periphery of the connecting member and a lower inner peripheral portion fitted to the protrusion. Or, preferably, the closing member may be provided between an outer surface of the connecting member and an inner surface of the penetrating hole. Thereby, the penetrating hole may be sealed with a simple structure.

According to the present invention, there is provided a jet-propulsion personal watercraft equipped with an engine including a crankshaft extending along a longitudinal direction of a body of the watercraft and having a rear end portion for taking out an output from the engine, and an air-intake passage and an exhaust passage extending inside a cylinder head along a lateral direction of the body, the engine comprising a cylinder head cover provided over the cylinder head; an ignition plug attached to the cylinder head; a penetrating hole formed to extend from an upper surface of the cylinder head cover to a lower surface of the cylinder head through the cylinder head cover and the cylinder head, for accommodating and attaching the ignition plug inside thereof, the penetrating hole including a step portion axially supporting the ignition plug, and a screw portion extending downwardly from the step portion to open in the lower surface of the cylinder head, for fixing the ignition plug; a connecting member connected to an upper end of the ignition plug and located inside the penetrating hole, for connecting a power supply that activates the ignition plug to the ignition plug; a closing member for creating a seal between the connecting member and the penetrating hole; and an air hole formed to extend obliquely downward from a vicinity of the step portion so as to communicate with an outside of the cylinder head.

Thereby, it is possible to obtain the personal watercraft comprising the engine capable of preventing water ingress into the periphery of the ignition plug.

Preferably, the air hole may open into an outer face of the cylinder head at a position lower than an opening of the air-intake passage or the exhaust passage. In this structure, it is possible to prevent water splashed by a rotating member of the engine from flowing into the penetrating hole through the air hole.

Preferably, the air hole may be located on a right-side portion of the engine as seen from behind when a propeller shaft rotates clockwise as seen from behind, or located on a left-side portion of the engine as seen from behind when the propeller shaft rotates counterclockwise as seen from behind. In this structure, it is possible to prevent water splashed by the rotating member of the engine from flowing into the penetrating hole through the air hole.

The above and further objects and features of the invention will be more fully be apparent from the following detailed description with the accompanying drawings.

DETAILED DESCRIPTION OF THE PREFERRED EMBODIMENTS

A preferred embodiment of the present invention will be described below with reference to the drawings.

Figure 1:
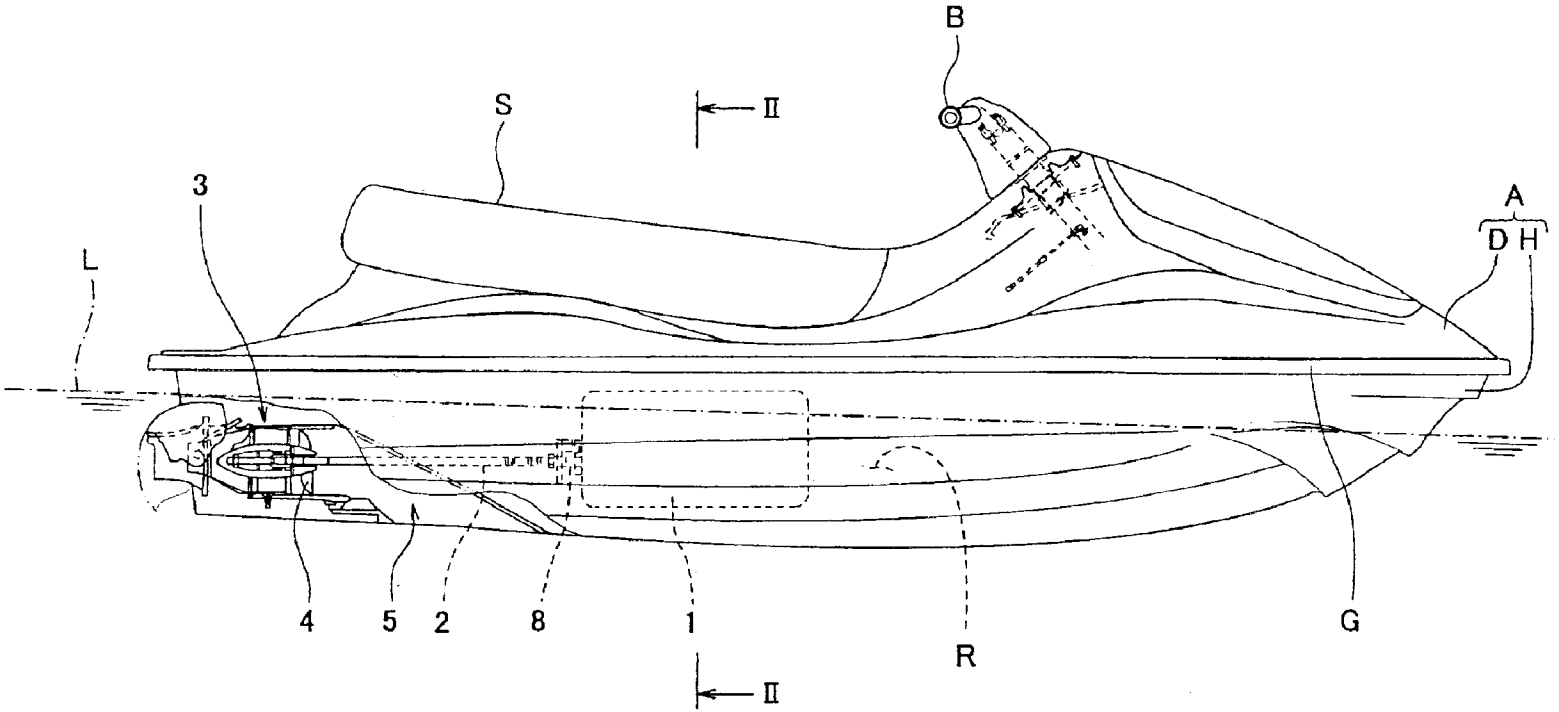
FIG. 1 is a partially cutaway side view showing a jet-propulsion personal watercraft to which the present invention is applied.
Figure 2:
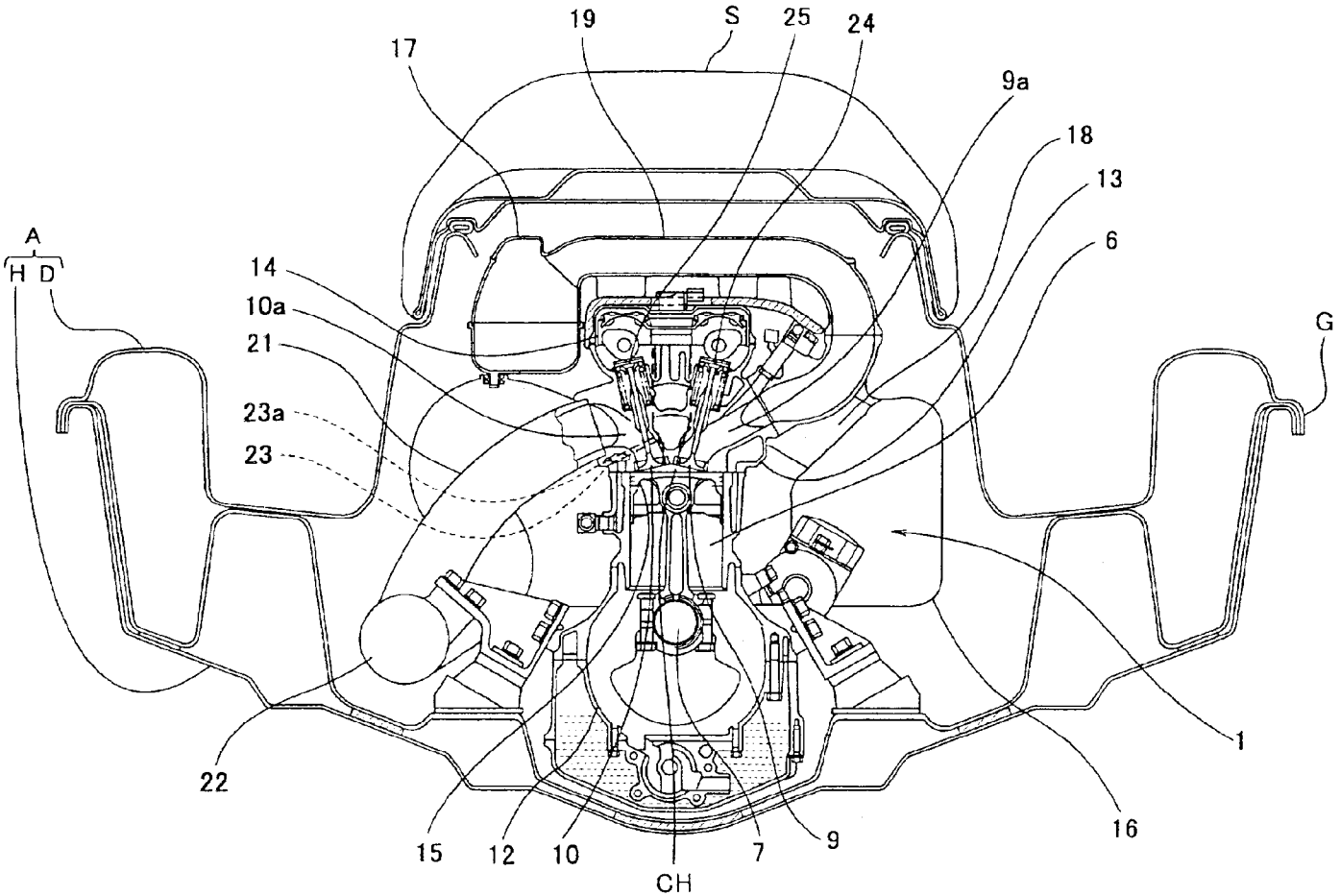
FIG. 2 is a cross-sectional view taken along line II—II in FIG. 1, showing an engine according to an embodiment of the present invention.

Referring now to FIGS. 1 and 2, a body A comprises a hull H and a deck D covering the hull H from above. A line at which the hull H and the deck D are connected over the entire perimeter thereof is called a gunnel line G. A straddle-type seat S configured to be straddled by a rider is mounted onto an upper surface of the body A so as to extend substantially from a center portion to a rear portion of the deck D in the longitudinal direction of the watercraft. An engine 1 is disposed in a chamber (engine room) R surrounded by the hull H and the deck D below the seat S.

The engine 1 is a multiple-cylinder (for example, four cylinders) four-cycle engine. Like the conventional engine described above, the engine 1 is mounted such that cylinders are arranged along the longitudinal direction of the body A and a crankshaft 7 extends along the longitudinal direction of the body A. A propeller shaft 2 is connected to a rear end portion (a portion for taking out an output from the engine 1) of the crankshaft 7 through a coupling 8 so as to extend along the longitudinal direction of the body A. The propeller shaft 2 causes an impeller 4 of a water jet pump 3 provided on the rear side of the body A to rotate. Thereby, the water sucked from a water intake 5 formed on a bottom surface of the watercraft is ejected rearward and, as the resulting reaction, the body A obtains a propulsion force. In FIG. 1, B denotes a bar-type steering handle. As used herein, "forward" refers to the direction toward which the watercraft equipped with the engine 1 moves, and "rearward" refers to the opposite side. In other words, in the engine 1, the side where the coupling 8 for connecting the propeller shaft 2 is connected is called a "rear side" or the side from which the output from the engine 1 is taken. Further, a direction perpendicular to the longitudinal direction of the watercraft is called a "lateral direction."

As shown in FIG. 2, the engine 1 comprises a crankcase 12, cylinders 6 located on the crankcase 12, a cylinder head 13 located on the cylinders 6, and a cylinder head cover 14 located over the cylinder head 13, in this order, as seen from below. The crankcase 12 contains the crankshaft 7. The cylinder 6 has a cylinder bore slidably supporting a piston 15 inside thereof. The cylinder head 13, the cylinder bore and the piston 15 form a combustion chamber CH of the engine E. The cylinder head cover 14 covers a valve system such as a cam shaft and a valve spring provided over the cylinder head 13. Inside the cylinder head 13 of the engine 1, air-intake passages 9*a* are provided on one side (right in FIG. 2) and exhaust passages 10*a* are provided on the other side (left in FIG. 2). One end of the air-intake passage 9*a* opens in the combustion chamber CH so as to form air-intake ports 9 and the other end thereof opens in an outer face of the cylinder head 13 so as to form an entrance thereof. One end of the exhaust passage 10*a* opens in the combustion chamber CH so as to form exhaust ports 10 and the other end thereof opens in the outer face of the cylinder head 13 so as to form an exit thereof. The air-intake ports 9 and the exhaust ports 10 open in the combustion chamber Ch. In an air-intake system for introducing ambient air into the combustion chamber CH, a first air-intake box 16 and a second air-intake box 17 are provided. In the air-intake system, air taken in from the first air-intake box 16 flows into the combustion chamber CH through a first air-intake pipe 18, a throttle valve (not shown) for adjusting an air-intake amount, a second air-intake box 17, second air-intake pipes 19 (e.g., four), and the air-intake passages 9*a* each of which branches into the two air-intake ports 9 which open in the cylinder 6 (see FIG. 3). The second air-intake pipes 19 are curved to extend from the second air-intake box 17 above the cylinder head cover 14 and are then curved downwardly. The second air-intake pipes 19 are further curved to return toward the second air-intake box 17 and connected to the entrance of the air-intake passage 9*a*. Exhaust manifolds 21 are each connected to the exit of the exhaust passage 10*a* of the cylinder head 13. The exhaust manifolds 21 are connected to an exhaust collecting pipe 22. In FIG. 2, reference numeral 24 denotes air-intake valves and reference numeral 25 denotes exhaust valves.

Figure 3:
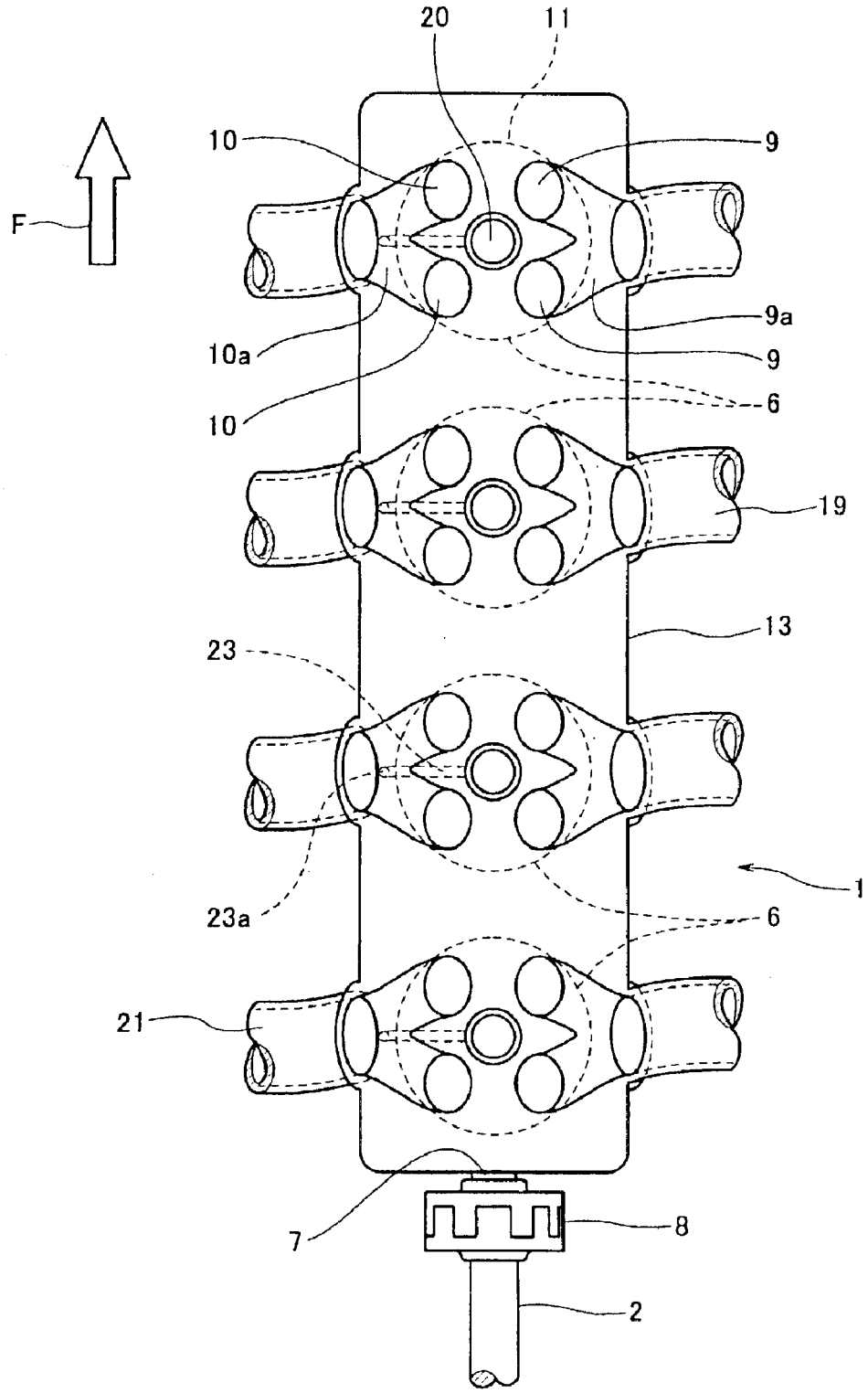
FIG. 3 is a sectional plan view, schematically showing an air-intake passage and an exhaust passage of the engine in FIG. 2.

FIG. 3 is a sectional plan view schematically showing the air-intake passages 9*a* and the exhaust passages 10*a* of the engine 1. An arrow F in FIG. 3 represents "forward." As shown in FIG. 3, the engine 1 has the two air-intake ports 9 and the two exhaust ports 10 for each cylinder 6 and the two air-intake valves 24 and the two exhaust valves 25 for each cylinder 6 (see FIG. 2), which is called a four-valve type. Each of the air-intake passage 9*a* branches into the two air-intake ports 9 inside the cylinder head 13. The second air-intake pipes 19 are each connected to an entrance of the air-intake passage 9*a*. Also, the two exhaust ports 10 are collected into the exhaust passage 10*a* inside the cylinder head 13, and the exhaust manifold 21 is connected to the exit of the exhaust passage 10*a* as described above. The cylinder head 13 is provided with penetrating holes 20, each of which is surrounded by the four ports 9, 10 and extends toward a center of the cylinder 6. To an inside of the penetrating hole 20, an ignition plug P and an ignition coil C (FIG. 4) are attached as mentioned below.

Figure 4:
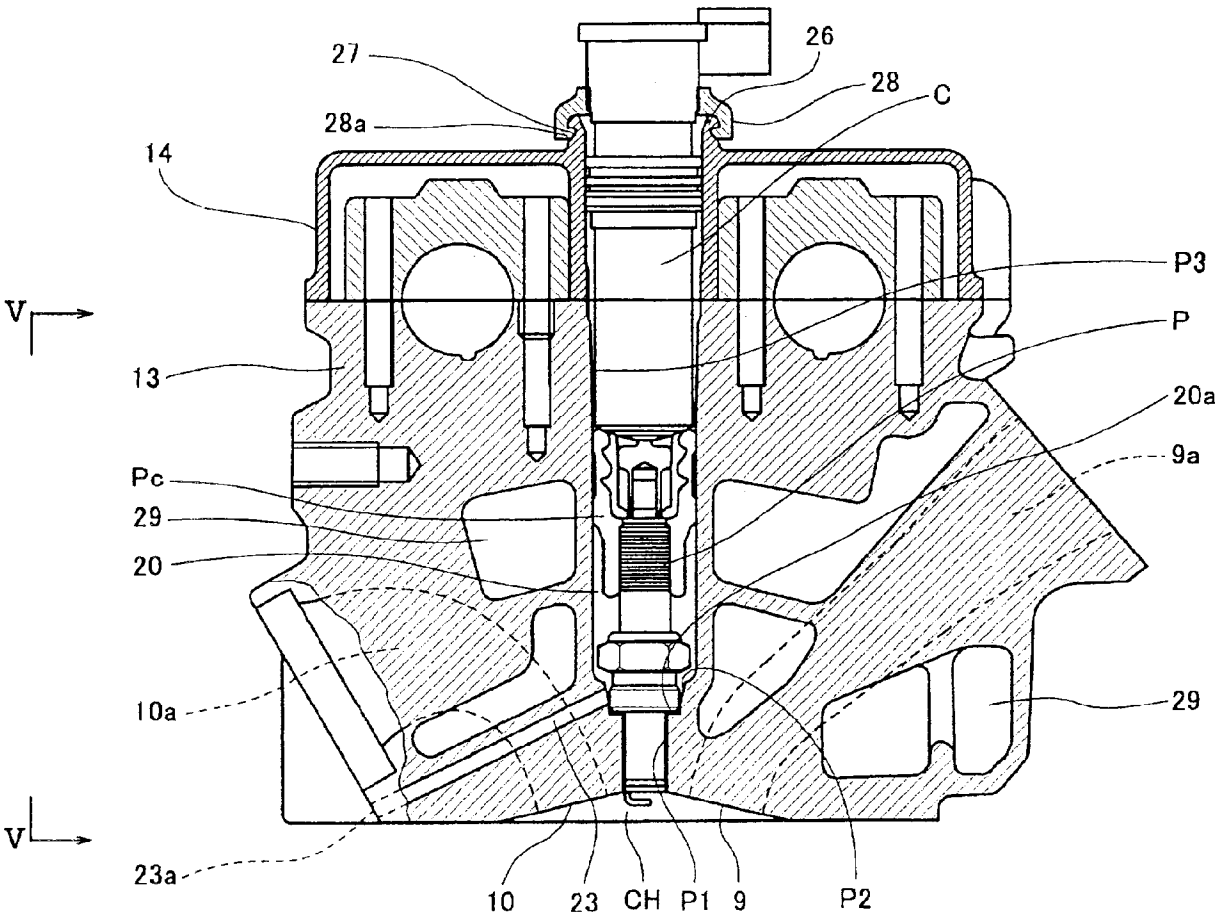
FIG. 4 is an enlarged transverse sectional view showing a cylinder head cover and a cylinder head of the engine in FIG. 2.

FIG. 4 is an enlarged transverse sectional view of the head cover 14 and the cylinder head 13 of the engine 1. As can be seen from FIG. 4, the penetrating hole 20 extends toward the center of the cylinder 6 (center of the combustion chamber CH) downwardly from an upper end face of the cylinder head cover 14 to a lower face of the cylinder head 13 (upper end of the combustion chamber CH) through a center portion of the cylinder head 13 (between the air-intake ports 9 and the exhaust ports 10). The ignition plug P and the stick-shaped ignition coil C provided with a plug cap Pc are attached to the inside of the penetrating hole 20, but the present invention is not intended to be limited to this structure. Alternatively, the ignition coil C may be attached to an outside of the penetrating hole 20 and a stick-shaped connecting member internally having a high-tension code for connecting the ignition coil provided outside the penetrating hole, to the ignition plug may be attached to the inside of the penetrating hole 20. Any removable connecting member other than the stick-shaped connecting member may be used herein.

As described above, the penetrating hole 20 is configured such that one end thereof opens in the lower face of the cylinder head 13 and the other end thereof opens in the upper face of the cylinder head cover 14. More specifically, as shown in FIG. 4, the penetrating hole 20 has an internal structure comprised of a screw portion P1 that opens in the lower face of the cylinder head 13 (upper end of the combustion chamber CH) for attaching the ignition plug P, a bearing surface (step portion) 20*a* located on the screw portion P1 to axially bear (support) the ignition plug P, a positioning portion P2 extending upwardly from the bearing surface 20*a* to be tapered with a diameter being slightly larger than that of the bearing surface 20*a* and increasing upwardly, and an accommodating portion (concave portion) P3 for accommodating the ignition plug P, the plug cap Pc, and the ignition coil C, or the connecting member for connecting the ignition plug P to the ignition coil C, and the like. The accommodating portion (concave portion) P3 extends upwardly from the positioning portion P2 inside the cylinder head 13 to the upper end of the cylinder head cover 14.

The accommodating portion (concave portion) P3 has an inner diameter sufficient to permit tools for attaching the ignition plug P to be inserted therethrough. In addition, the inner diameter of the accommodating portion P3 is sized to support an outer periphery of the stick-shaped ignition coil C (or connecting member). The penetrating hole 20 is provided with an air-release hole (simply referred to as an air hole) 23 that extends obliquely downward from a location immediately above the step portion 20*a* (side wall of the positioning portion P2 on the step portion 20*a*) to open in an outer face of a side wall of the cylinder head 13. Into the penetrating hole 20, the ignition plug P, the plug cap Pc, and the ignition coil C (or connecting member) are incorporated in the following procedure.

First, the ignition plug P is screwed into the screw portion P1 and is then secured to the screw portion P1 and the bearing surface 20*a*. At this time, a seal packing is sandwiched between the bearing surface 20*a* and the ignition plug P. Then, the ignition coil C provided with the plug cap Pc at its lower end (or connecting member) is inserted into the accommodating portion P3 of the penetrating hole 20 and is thereby coupled to an electrode in an upper portion of the ignition plug P. Simultaneously, the plug cap Pc is outerly fitted to the upper portion of the ignition plug P, thereby sealing a coupling portion of the electrode from outside.

As shown in FIG. 4, a circular protrusion 26 is provided on a periphery of an opening of the accommodating portion (concave portion) P3 in the upper surface of the cylinder head cover 14, for mounting a seal ring (closing member). A groove 27 extends circumferentially on an outer peripheral face of the protrusion 26. The seal ring 28 is made of a soft material such as rubber. The seal ring 28 is first outerly fitted to the stick-shaped ignition coil C (or connecting member) attached to the accommodating portion P3, and is then attached to the protrusion 26. The seal ring 28 has an upper inner peripheral portion outerly fitted to the ignition coil C (or connecting member) and a circumferentially extending engagement protrusion 28*a* as a lower inner peripheral portion that engages with the groove 27 of the protrusion 26. The seal ring 28 seals between an outer peripheral face of the ignition coil C (or connecting member) and an outer peripheral face of the protrusion 26 in the upper surface of the cylinder head cover 14, thereby preventing water ingress into the accommodating portion P3.

The seal may be achieved by attaching a closing member such as an O-ring between the outer peripheral face of the ignition coil C (or connecting member) and the inner peripheral face of the accommodating portion P3, thereby preventing outside water from entering the accommodating portion P3 from above. Alternatively, the closing member may be formed integrally with the outer peripheral face of the ignition coil C (or connecting member). Instead of sealing by the closing member, a dome-shaped member which prevents water ingress into the accommodating portion P3 may be provided above the penetrating hole 20 as the closing member.

The functions of air hole 23 will now be described. With the accommodating portion (concave portion) P3 sealed by the closing member for preventing water ingress, air in a space around the ignition plug P thermally expands during starting of the engine. This causes the ignition coil C (or connecting member) to be pushed up, which leads to an unstable coupling between the ignition coil C (or connecting member) and the ignition plug P under an oscillating condition. To avoid the unstable coupling, the air hole 23 releases the air inside the accommodating portion P3 to the outside. In the case of using a closing member that incompletely closes the accommodating portion P3, the air hole 23 also serves to discharge a small amount of water entering the accommodating portion P3.

As described above, to prevent water ingress through an opening of the air hole 23, the air hole 23 extends linearly and obliquely downward from the step portion 20*a* to an outside of the cylinder head 13. This structure allows the water entering through the opening of the air hole 23 to be discharged by gravity through the air hole 23. In FIG. 4, reference numeral 29 denotes a water jacket.

Figure 5:
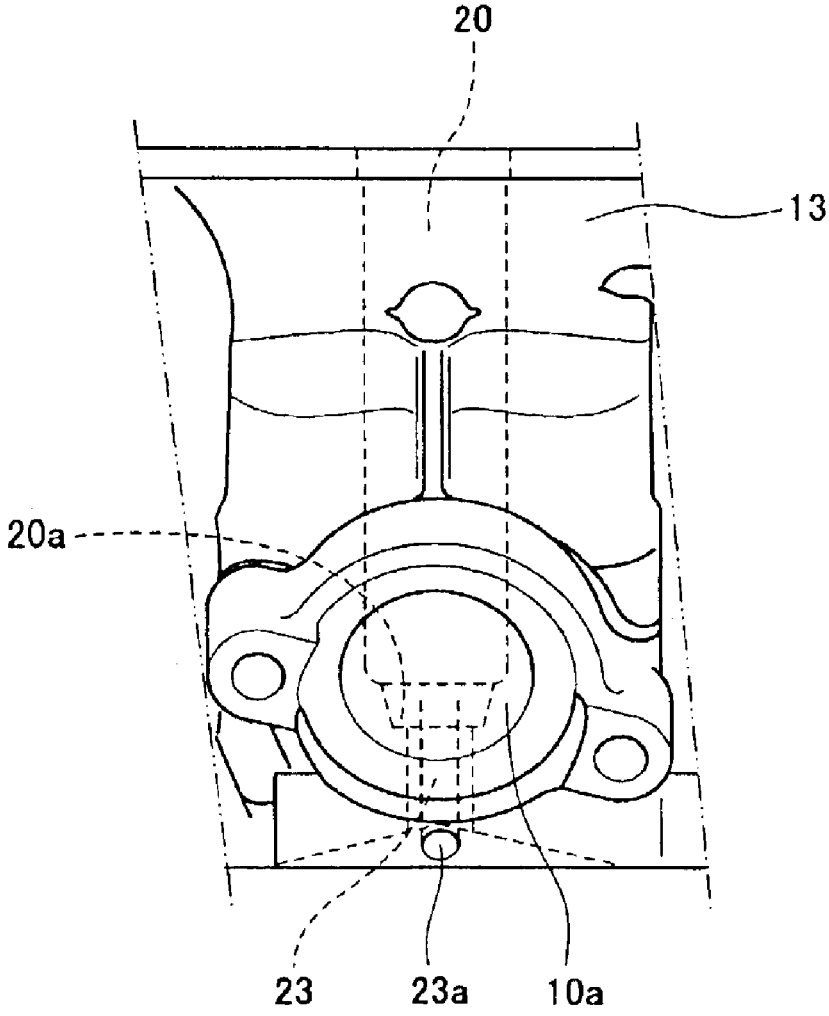
FIG. 5 is a view taken in the direction of arrows along line V—V in FIG. 4.

As clearly shown in FIGS. 3, 4, and 5, the air hole 23 extends between branching portions of the exhaust passage 10*a* and its exit 23*a* is located immediately below the exit of the exhaust passage 10*a*. In this structure, a lower end of the exit of the exhaust passage 10*a* formed in the cylinder head 13 is located lower than the step portion 20*a* of the penetrating hole 20 and the exhaust manifold 21 connected to the exit of the exhaust passage 10*a* is provided over the exit 23*a* of the air hole 23. The exhaust manifold 21 prevents water splashed up by a rotating member such as the coupling 8 exposed in the engine room R (FIG. 1) from entering the air hole 23 from the exit 23*a*. FIG. 5 is a view taken in the direction of arrows along line V—V in FIG. 4.

The air hole 23 in FIGS. 3 to 5 opens at the position immediately below the exit of the exhaust passage 10*a*, but this is only illustrative. For example, when a lower end of the entrance of the air-intake passage 9*a* is located lower than the step portion 20*a* of the penetrating hole 20 and the second air-intake pipe 19 is connected to the air-intake passage 9*a* to extend horizontally or obliquely downward, the air hole 23 may be formed to extend from the step portion 20*a* to a position immediately below the entrance of the air-intake passage 9*a*. In this structure, the second air-intake pipe 19 is provided over the exit 23*a* of the air hole 23. In brief, it is required that the exit 23*a* of the air hole 23 be present at any suitable location where water splashed up by the rotating member in the vicinity of the engine E only slightly enters the air hole 23. By way of example, the exit 23*a* of the air hole 23 is positioned under the second air-intake pipe 19 or the exhaust manifold 21.

In order to effectively prevent the water ingress into the air hole 23, it is desirable to mount the above engine in the personal watercraft in view of the rotational direction of the coupling 8 and the propeller shaft 2 exposed in the engine room R and rotating in the vicinity of the engine E, i.e., the direction toward which water is splashed up. For example, when the propeller shaft 2 rotates clockwise as seen from behind, water tends to be splashed up obliquely leftward. Therefore, preferably, the air hole 23 is formed to extend from the step portion 20*a* to open in the outer face of the right side wall of the engine E as seen from behind. Conversely, when the propeller shaft 2 rotates counterclockwise, water tends to be splashed up obliquely rightward, and therefore, the air hole 23 preferably opens in an outer face of a left side wall of the engine E as seen from behind.

Figure 6:
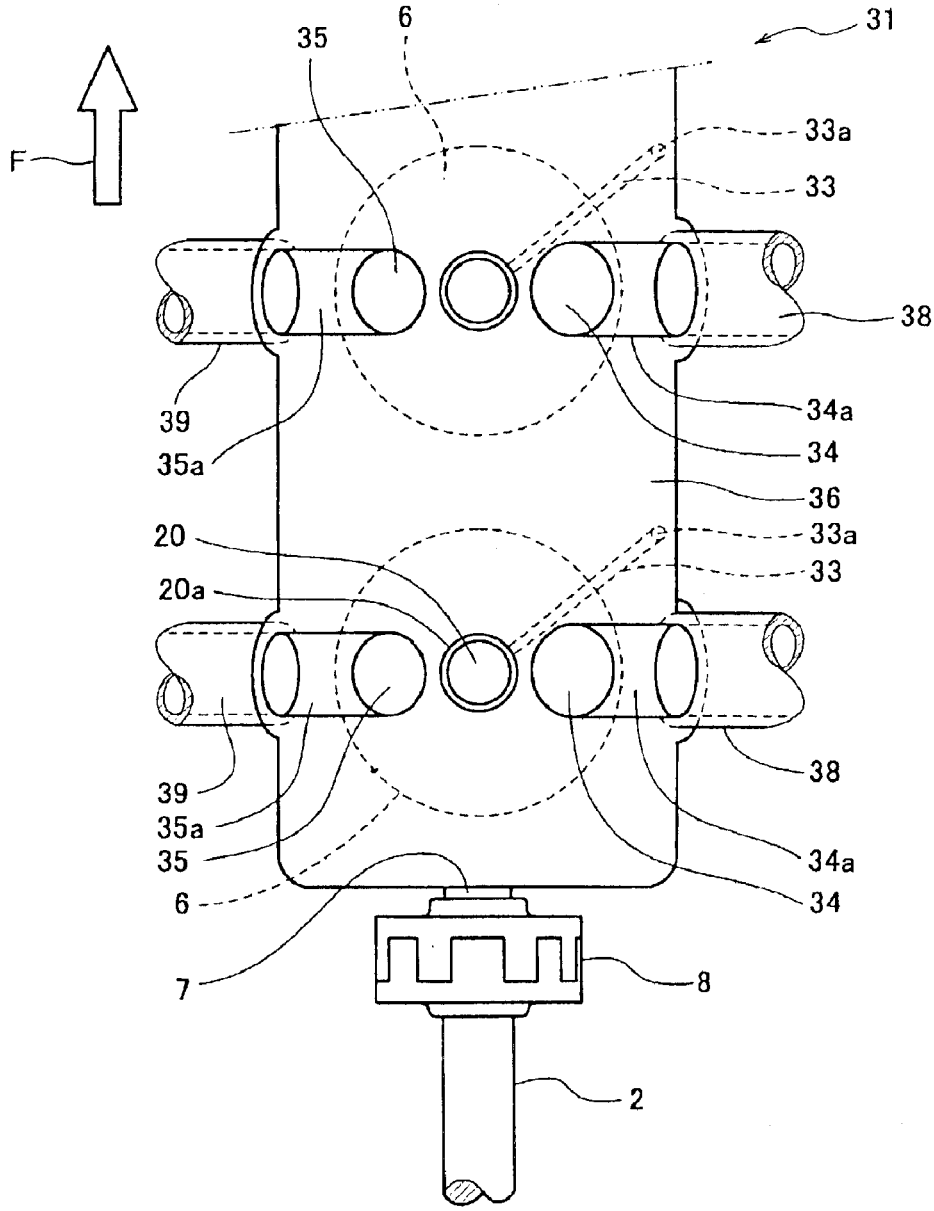
FIG. 6 is a sectional plan view schematically showing an air-intake passage and an exhaust passage of an engine according to another embodiment of the present invention.

FIG. 6 shows a two-valve type engine 31, having one air-intake port 34 and one exhaust port 35, and one air-intake valve and one exhaust valve (not shown), for each cylinder 6. In the engine 1 in FIG. 3, the air-intake passage 9*a* is branched into the two air-intake ports 9 and the two exhaust ports 10 are collected into the exhaust passage 10*a*, whereas in the engine 31 in FIG. 6, an air-intake passage 34*a* does not branch into two air-intake ports and two exhaust ports are not collected into an exhaust passage 35*a*. In the engine 31, an air hole 33 is formed to extend from the position immediately above the step portion 20*a* of the penetrating hole 20 that accommodates the ignition plug P through a cylinder head 36 and its exit 33*a* opens in an outer face of a side wall of the cylinder head 36. The air hole 33 passes in front of the air-intake passage 34*a* to an outer face of the side wall of the cylinder head 36. In FIG. 6, an arrow F indicates "forward." The exit 33*a* is located in front of an entrance of the air-intake passage 34*a* and opens at a position lower than a second air-intake pipe 38 connected to the entrance of the air-intake passage 34*a*. The second air-intake pipe 38 prevents water splashed up by the coupling 8 and the like from entering through the exit 33*a* of the air hole 33.

The air hole 33 is formed to extend linearly and obliquely downward from the step portion 20*a* of the penetrating hole 20 to which the ignition plug P or the like is attached, to an outside of the cylinder head 36, although not shown in FIG. 6.

In the engine 31, the air hole 33 is not necessarily located on the side of the air-intake passage 34*a*. For example, when the lower end of the exit of the exhaust passage 35*a* is located lower than the step portion 20*a* of the penetrating hole 20 and the exhaust manifold 39 is connected to the exhaust passage 35*a* to extend outwardly, the air hole 33 may be formed to extend from the step portion 20*a* to a position forward of an entrance of the exhaust passage 35*a*. In this structure, the exit 33*a* of the air hole 33 is covered from above or behind by the exhaust manifold 39.

The position and structure of the air hole 23(33) is not intended to be limited to the above so long as backflow of water can be prevented.

The air hole 23(33) is not necessarily linear, but needs to be lowered as it is distant from the penetrating hole 20 to the outside of the engine E. Nonetheless, the linear air hole is easily processed.

While the four-valve engine and the two-valve engine have been specifically described, the present invention is applicable to a three-valve engine or a five-valve engine.

While the present invention has been described in terms of a preferred embodiment of the straddle-type personal watercraft, it is to be understood that the present invention is applicable to other personal watercraft including a stand-up type personal watercraft.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. An engine of a personal watercraft, comprising:

a cylinder head;

a cylinder head cover provided over the cylinder head;

an ignition plug attached to the cylinder head;

a penetrating hole formed to extend from an upper surface of the cylinder head cover to a lower surface of the cylinder head through the cylinder head cover and the cylinder head, for accommodating and attaching the ignition plug inside thereof, the penetrating hole including a step portion axially supporting the ignition plug, and a screw portion extending downwardly from the step portion to open in the lower surface of the cylinder head, for fixing the ignition plug;

a connecting member connected to an upper end of the ignition plug and located inside the penetrating hole, for connecting a power supply that activates the ignition plug to the ignition plug;

a closing member for creating a seal between the connecting member and the penetrating hole; and an air hole formed to extend obliquely downward from a vicinity of the step portion so as to communicate with an outside of the cylinder head.

2. The engine of a personal watercraft according to claim 1, wherein the connecting member is comprised of a stick-shaped member protruding from an upper end of the penetrating hole.

3. The engine of a personal watereraft according to claim 2, wherein the connecting member contains an ignition coil inside thereof.

4. The engine of a personal watercraft according to claim 2, wherein the penetrating hole is provided with an engagement protrusion on a periphery of an opening at an upper end of the penetrating hole, and the closing member is comprised of an upper inner peripheral portion in contact with a periphery of the connecting member and a lower inner peripheral portion fitted to the protrusion.

5. The engine of a personal watereraft according to claim 2, wherein the closing member is provided between an outer surface of the connecting member and an inner surface of the penetrating hole.

6. The engine of a personal watercraft according to claim 5, wherein the closing member is comprised of an O-ring.

7. A jet-propulsion personal watercraft equipped with an engine including a crankshaft extending along a longitudinal direction of a body of the watercraft and having a rear end portion for taking out an output from the engine, and an air-intake passage and an exhaust passage extending inside a cylinder head along a lateral direction of the body, the engine comprising:

a cylinder head cover provided over the cylinder head;

an ignition plug attached to the cylinder head;

a penetrating hole formed to extend from an upper surface of the cylinder head cover to a lower surface of the cylinder head through the cylinder head cover and the cylinder head, for accommodating and attaching the ignition plug inside thereof, the penetrating hole including a step portion axially supporting the ignition plug, and a screw portion extending downwardly from the step portion to open in the lower surface of the cylinder head, for fixing the ignition plug;

a connecting member connected to an upper end of the ignition plug and located inside the penetrating hole, for connecting a power supply to the ignition plug that activates the ignition plug;

a closing member for creating a seal between the connecting member and the penetrating hole; and an air hole formed to extend obliquely downward from a vicinity of the step portion so as to communicate with an outside of the cylinder head.

8. The jet-propulsion personal watercraft according to claim 7, wherein the air hole opens in an outer face of the cylinder head at a position lower than an opening of the air-intake passage or the exhaust passage.

9. The jet-propulsion personal watercraft according to claim 8, wherein the air hole is located on a right-side portion of the engine as seen from behind when a propeller shaft rotates clockwise as seen from behind, or located on a left-side portion of the engine as seen from behind when the propeller shaft rotates counterclockwise as seen from behind.

10. The jet-propulsion personal watercraft according to claim 7, wherein the air hole opens in an outer face of the cylinder head at a position lower than and forward of an opening of the air-intake passage or the exhaust passage.

* * * * *